US005832864A

United States Patent [19]

Hemphill

[11] Patent Number: 5,832,864

[45] **Date of Patent: *Nov. 10, 1998**

[54] DIVER'S DOOR FOR INFLATABLE BOAT

[75] Inventor: Douglas Hemphill, Delta, Canada

[73] Assignee: Zodiac Hurricane Technologies, Inc., Delta, Canada

[ * ] Notice: The term of this patent shall not extend beyond the expiration date of Pat. No. 5,579,714.

[21] Appl. No.: 877,474

[22] Filed: Jun. 17, 1997

[51] Int. Cl.[6] ..... B63B 7/08

[52] U.S. Cl. ..... 114/345; 114/362

[58] Field of Search ..... 114/345, 362; 441/39, 40

[56] References Cited

U.S. PATENT DOCUMENTS

| | | | |
|---|---|---|---|
| 1,867,563 | 7/1932 | Clarke | 114/345 |
| 3,781,933 | 1/1974 | Soter | 114/345 |
| 3,931,655 | 1/1976 | Luscombe | 114/345 |
| 4,159,551 | 7/1979 | Iwai | 114/345 |
| 4,329,751 | 5/1982 | Cigognetti | 114/345 |
| 4,449,473 | 5/1984 | McCrory et al. | 114/345 |
| 4,498,413 | 2/1985 | Cochran | 114/345 |
| 4,989,691 | 2/1991 | Wilkerson et al. | 114/362 |
| 5,170,738 | 12/1992 | Patten | 114/345 |
| 5,579,714 | 12/1996 | Hemphill | 114/362 |

FOREIGN PATENT DOCUMENTS

| | | | |
|---|---|---|---|
| 4-100793 A | 4/1992 | Japan | 114/362 |

*Primary Examiner*—Sherman Basinger
*Attorney, Agent, or Firm*—Larson & Taylor

[57] ABSTRACT

A diver's door which provides easy access to and from an inflatable boat for a diver and which can be replaced to minimize water leakage into the deck of the boat, is described. The diver's door is a removable tube element provided with a flexible flange which fits into a slot along the top edge of the hull. The removable tube element includes at least one peripheral hoop flange at one end for maintaining the removable tube element in position when fully inflated. Also disclosed are an inflatable boat including the diver's door of the present invention and a method for providing access to an inflatable boat using the diver's door of the present invention.

14 Claims, 2 Drawing Sheets

DIVER'S DOOR FOR INFLATABLE BOAT

BACKGROUND OF THE INVENTION

1. Field of the Invention

The present invention relates to a diver's door for use on inflatable boats in order to provide access to the boat.

2. Description of the Prior Art

Numerous examples of inflatable boats are known in the art. Several inflatable boats are formed from separable sections such as that disclosed in U.S. Pat. No. 4,159,551 (Iwai). This separable inflatable boat is formed from a covering having a hollow peripheral casing and a flat deck and a floatable member accommodated in the casing. The floatable member includes a plurality of floatable bags which are separably interconnected by slide fasteners and can be conveniently carried separately from the covering. This boat, however, has no provision for removing a section of the boat during use in order to improve diver access thereto.

U.S. Pat. No. 3,931,655 (Luscombe) discloses an inflatable boat of sectional construction including a bow section, an intermediate section and a stern section which are releasably secured together. Each section includes inflatable side members that are generally rectangular and which form the sides of the boat. Inflatable transverse members of each section are secured together and serve as seats for the boat. The sections may be readily disconnected from each other and each section may then serve as a small buoyant craft. Again, this boat has no provision for removing a portion of the side wall in order to improve diver access but rather is separable into three distinct boats.

U.S. Pat. No. 4,449,473 (McCrory et al.) discloses an inflatable boat having parallel side sponsors joined by a floor and having a rigid keelson member including a demountable transom capable of supporting an outboard motor. The transom may be removed from the boat for storage but no provision is made for removal of the transom from the boat during use.

U.S. Pat. No. 5,170,738 (Patten) discloses an inflatable vessel for marine divers having an opening in the fabric bottom or deck to enable divers to board the vessel from the water through the opening without swamping the vessel. The advantage of this particular boat is that no rigid framework is required. However, this boat requires that the deck or bottom be suspended above the water line in order to prevent flooding of the interior of the boat when the access opening is opened.

U.S. Pat. No. 5,170,738 also mentions that existing vehicles available for use in similar operations may be partially rigid with an inflatable tube supporting a rigid frame which forms a well for entry. Such boats suffer from the disadvantage, however, that the entry well cannot be closed and thus typically provides a means for ingress of water to the boat through the well during use.

U.S. Pat. No. 3,781,933 (Soter) discloses a one-man inflatable life raft with an inflatable tube peripherally bounding an occupant receiving space having a flexible floor member. The boat includes a zippered opening in the floor to be used for entry thus avoiding the necessity of climbing over the peripheral tube and facilitating the use of a constant diameter tube as opposed to conventional tubes that are tapered at one end to facilitate boarding over the side. Again, this boat suffers from the disadvantage that water will enter the boat when the zippered opening in the floor is opened thereby swamping the boat or at least wetting the contents of the boat.

U.S. Pat. No. 4,498,413 (Cochran) discloses a rigid inflatable boat including multiple inflatable bladders defining a ring around the hull generally at or above the water line. The inflatable bladders are connected to the hull and to each other in a manner facilitating rapid mounting and demounting and easy repair thereof. This is accomplished by a positioning structure formed in the hull for positioning each bladder with respect to the hull and a holding structure to releasably hold each bladder to the hull when the bladder is inflated while allowing ready demounting when the bladder is deflated. The bladders may be provided with interlocking end structures to stabilize the positions of the bladders with respect to each other and the hull.

U.S. Pat. No. 4,498,413 does not contemplate removal of one or more sections of the boat during use in order to facilitate entry or exit of a diver to or from the boat but rather is designed solely for the purpose of facilitating disassembly of the boat for repair or replacement of one or more of the inflatable bladders.

Accordingly, there is a need in the art for an inflatable boat which provides for easy access to the boat by a diver while at the same time does not unduly expose the interior of the boat to the water.

Thus, it is the primary object of the present invention to provide an inflatable boat including a means for providing access to the boat for a diver while at the same time not exposing the boat to ingress of water.

This and other objects of the present invention will be apparent from the summary and detailed descriptions which follow.

SUMMARY OF THE INVENTION

In a first aspect, the present invention relates to a diver's door for an inflatable boat which includes an inflatable tube element which is removable from the sidewall of an inflatable boat. The removable tube element further includes at least one hoop flange located at an end of the tube element for releasably retaining the removable tube element on the deck of a boat when the diver door is closed.

In a second aspect, the present invention relates to an inflatable boat including a deck, a plurality of inflatable tube elements which are attached the deck and extending at least partially around the deck to form the sidewall of the boat. At least one of the inflatable tube elements is removable to create a space in the sidewall of the boat to permit passage of a diver into or out of the boat through said space.

A third embodiment of the present invention relates to a method of providing access to an inflatable boat having a deck provided with a plurality of inflatable tube elements which extend at least partially around the deck to form the sidewall of the boat with one inflatable tube element being removable from the deck. The method includes the steps of partially deflating the removable tube element and removing the removable tube element from the deck of the boat to provide a space in the sidewall.

The present invention provides an apparatus and method for providing access for a diver to an inflatable boat while minimizing the exposure of the deck of the boat to ingress of water. In this manner, the problem of the prior art inflatable boats has been solved.

DETAILED DESCRIPTION OF THE PREFERRED EMBODIMENTS

In the following description, like numerals represent like elements throughout the several views.

Figure 1:
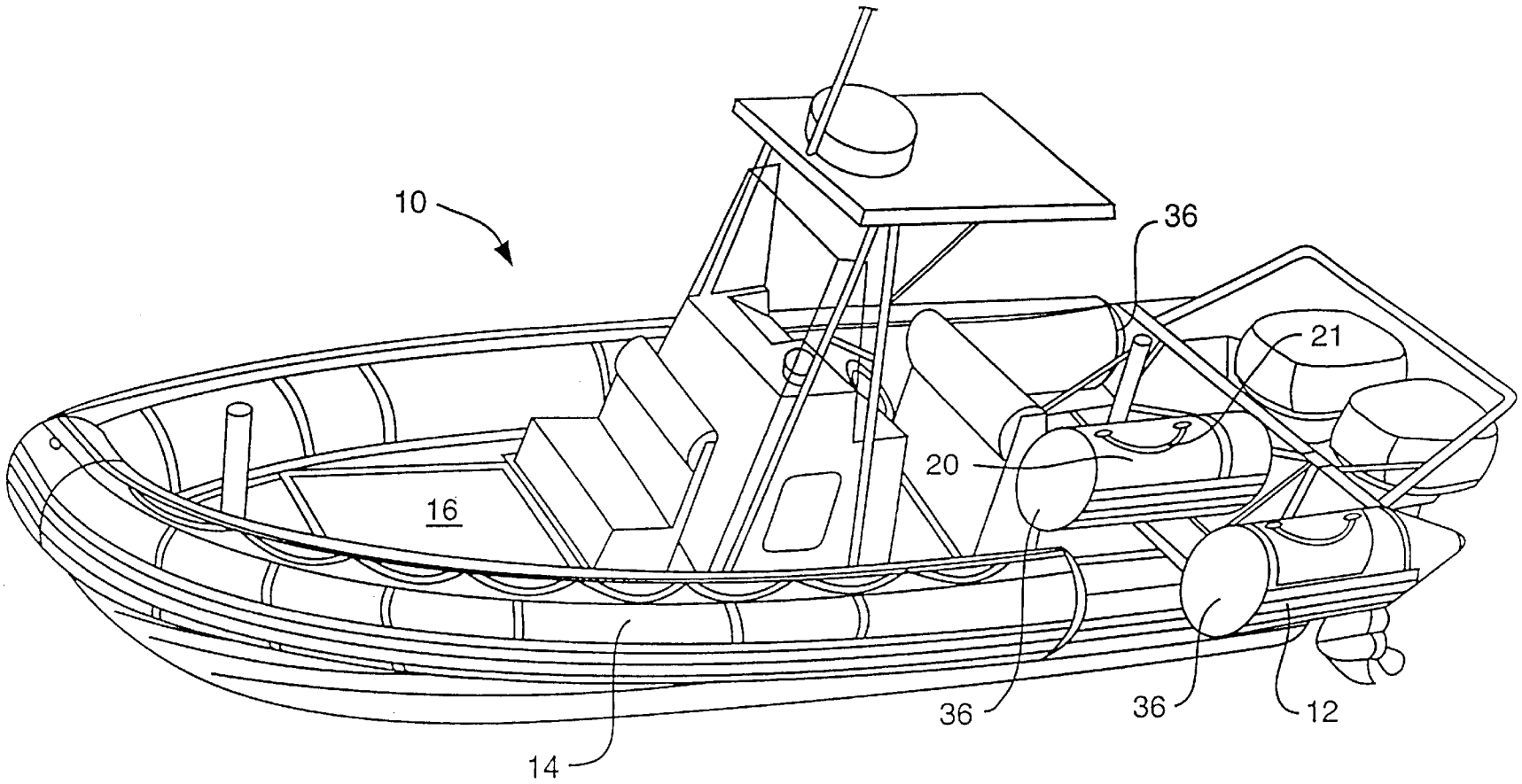
FIG. 1 depicts an inflatable boat as seen from outside of the boat and including the diver's door of the present invention shown displaced from its position on the deck.

Referring to FIG. 1, there is shown a rigid inflatable boat 10 which includes a first inflatable tube element 12, located at the stern of the boat 10 and extending along one side thereof and a second inflatable tube element 14 extending along the remainder of the one side of the boat 10 and continuing around the bow and the other side of the boat 10 to the opposite side of the stern. Both tube elements 12 and 14 are attached to the deck which is made of a rigid material. Apart from removable inflatable tube element 20 described in more detail below, boat 10 is otherwise conventional and thus further description of the boat per se will be dispensed with.

Also shown in FIG. 1 is the removable inflatable tube element 20 which is depicted out of its position between first inflatable tube element 12 and second inflatable tube element 14. Tube elements 12, 14 and 20 together form the sidewall of inflatable boat 10. As can be seen from FIG. 1, removal of the displaceable chamber 20 creates an opening between first inflatable tube element 12 and second inflatable tube element 14 through which a diver may enter or leave inflatable boat 10. Removable tube element 20 preferably has a length of less than 20% of the total length of the sidewall, and more preferably removable tube element 20 has a length of less than 15% of the total length of the sidewall.

Each of the inflatable tube elements 12, 14 and removable tube element 20 include end caps 36 on the ends thereof. End caps 36 are typically formed from a fabric material and end caps 36 serve to define the form of the inflatable tube elements 12, 14 and 20 as well as provide structural stability thereto.

Also shown in FIG. 1 is a handle means 21 attached to removable tube element 20. Handle means 21 is employed for grasping the removable tube element 20 and removing it from its position between inflatable tube element 12, 14. Handle means 21 may be a short length of rope fastened at both ends as shown in FIG. 1, or it may be any other suitable handle means such as a plastic handle, two rings attached to the removable tube element 20 or any other known means for grasping objects.

Figure 2:
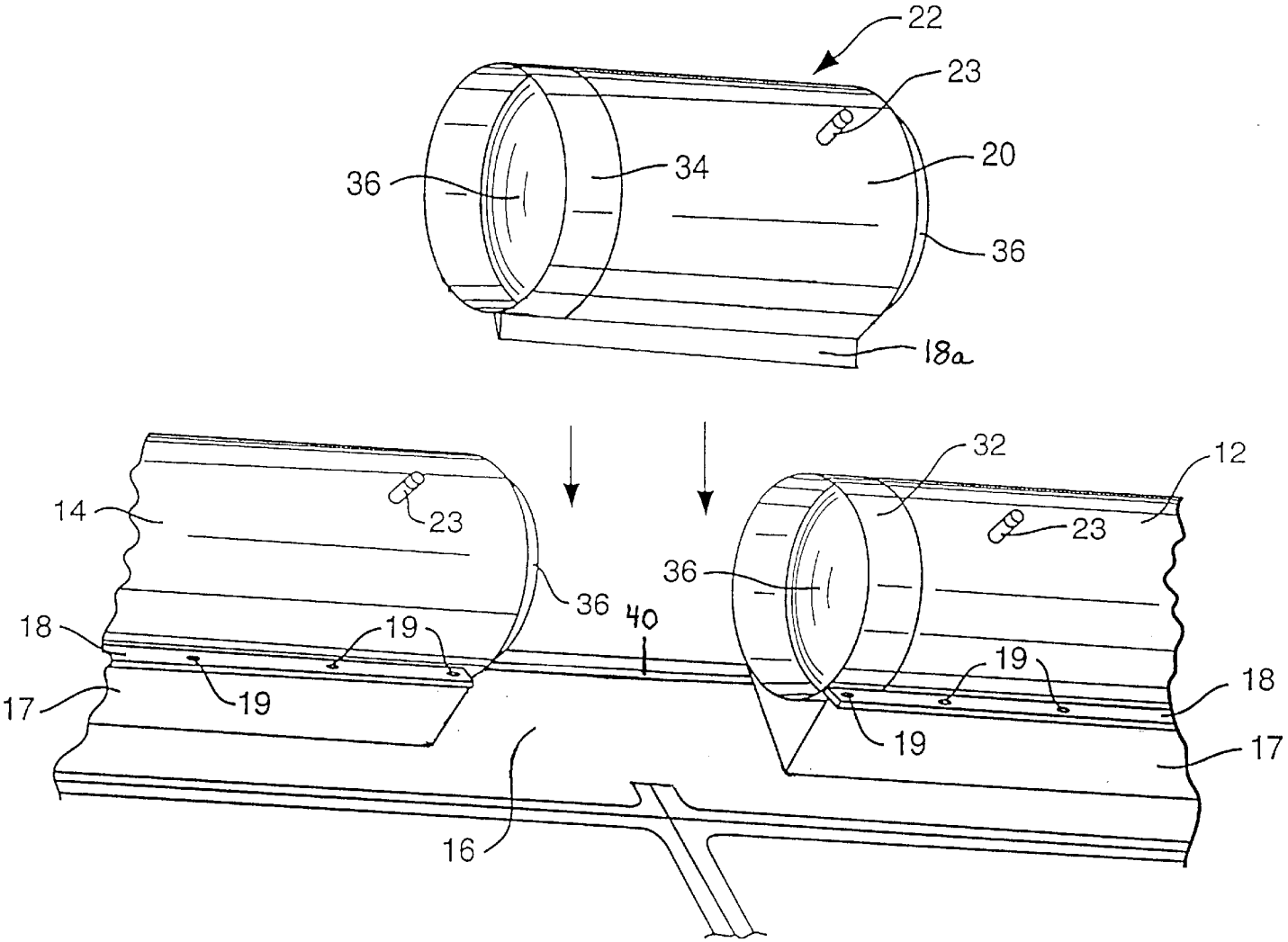
FIG. 2 is an enlarged view of the section of the inflatable boat of FIG. 1, as seen from inside the boat, which includes the diver's door which is again shown displaced from its position on the deck.

Referring now to FIG. 2, there is shown a close-up view of the area of inflatable boat 10 which includes the diver door 22 as seen from inside inflatable boat 10 looking towards the outside.

FIG. 2 shows that inflatable tube elements 12,14 are attached to deck 16 via tube cradle 17. There is no tube cradle 17 in the area of the displaceable tube element 20. Inflatable tube elements 12,14 are provided with attachment flanges 18 which may be attached to tube cradle 17 using screws 19 or any other suitable means such as bolts, for example. Removable tube element 20 also includes a flange 18*a* which is engaged in a slot 40 in the hull to prevent entry of water when diver door 22 is closed. Flange 18*a* is preferably flexible to facilitate insertion of the diver door 22 into position between inflatable tube elements 12, 14. When removable tube element 20 is fully inflated the tube pressure will force flange 18*a* into slot 40 to prevent entry of water into the boat below removable tube element 20.

Diver door 22 includes a first hoop flange 34 which is adapted to fit around the adjacent end of second inflatable tube element 14 to thereby provide structural stability to the boat and substantially prevent passage of water between removable tube element 20 and second inflatable tube element 14.

First inflatable tube element 12 further includes a second hoop flange 32 located at the end of first inflatable tube element 12 which is adjacent to diver door 22. Second hoop flange 32 provides additional structural stability to first inflatable tube element 12 and removable tube element 20 while also substantially preventing passage of water between first inflatable tube element 12 and removable tube element 20.

Hoop flanges 32, 34 are typically formed from a semi-rigid material. Hoop flanges 32, 34 maintain the removable tube element 20 in place when removable tube element 20 is fully inflated.

Finally, inflatable tube elements 12, 14, 20 each include a means for wholly or partially inflating/deflating 23 the tube elements 12, 14, 20. The inflating/deflating means 23 may be any conventional means known for this purpose such as valve.

In operation, diver door 22 including removable inflatable tube element 20 is provided in partially or completely deflated form. The partially or completely deflated diver door 22 is inserted in position between inflatable tube elements 12, 14 with end cap 36 of removable tube element 20 positioned within hoop flange 32 of inflatable tube element 12.

Then, removable tube element 20 is inflated to its fully inflated condition whereby it fills the opening between inflatable tube elements 12, 14 and forces hoop flange 34 over rigid end cap 36 of second inflatable tube element 14.

To remove diver door 22 from inflatable boat 10, removable tube element 20 is partially or completely deflated using inflating/deflating means 23 such that hoop flange 34 no longer encircles second inflatable tube element 14 at which point diver door 22 is grasped and removed from its position between inflatable chambers 12, 14 to create an opening through which a diver may enter or leave inflatable boat 10.

The foregoing specification has been presented for the purpose of illustration and description only and is not to be construed as limiting the invention in any way. The scope of the invention is to be determined from the claims appended hereto.

What is claimed is:

1. A diver's door for a rigid inflatable boat having a deck and a sidewall, said diver's door comprising an inflatable tube element having first and second ends which forms a section of the sidewall of the boat when in a fully inflated condition and is removable from the sidewall to provide a space which is large enough to permit a diver to enter or leave the boat through the space, at least one hoop flange attached to one end of the removable tube element and adapted to fit around an end of an adjacent tube element of the inflatable boat and means for at least partial deflation of the removable tube element to facilitate removal of the removable tube element from the deck of the boat.

2. A diver's door as claimed in claim 1, which further comprises rigid end caps integrally formed at the first and second ends of the removable tube element for providing form and structural stability to the removable tube element when in its fully inflated condition.

3. A diver's door as claimed in claim 1, wherein the removable tube element further comprises at least one flexible flange adapted to fit into a mating slot along the edge of the deck to prevent water from entering the boat when the diver's door is positioned in the sidewall in its fully inflated condition.

4. An inflatable boat comprising a sidewall and a deck having a perimeter, and a plurality of inflatable tube elements attached to the deck along a substantial portion of the perimeter of the deck to form the sidewall of the boat, wherein at least one of the tube elements is a removable tube element, said removable tube element including at least one hoop flange for releasably retaining the removable tube element in the sidewall, and upon removal of the removable tube element from the sidewall a space is created in the sidewall to permit passage of a diver into or out of the boat through the space.

5. An inflatable boat as claimed in claim 4, wherein the at least one removable tube element has a length of less than 20% of the total length of the sidewall of the boat.

6. An inflatable boat as claimed in claim 5, wherein the at least one removable tube element has a length of less than 15% of the total length of the sidewall of the boat.

7. An inflatable boat as claimed in claim 4, further comprising a second hoop flange attached to an end of one of the inflatable tube elements adjacent a second end of the removable tube element and adapted to fit around the second end of the removable tube element when the removable tube element is positioned in the sidewall in a fully inflated condition.

8. An inflatable boat as claimed in claim 7, wherein the deck is made of a rigid material.

9. An inflatable boat as claimed in claim 7, wherein the hoop flanges also substantially prevent passage of water between the removable tube element and adjacent tube elements when said removable tube element is positioned between said adjacent tube elements and is fully inflated.

10. An inflatable boat as claimed in claim 9, wherein the removable tube element has first and second ends which are each provided with an end cap of fabric material which imparts strength, form and durability to the removable tube element.

11. An inflatable boat as claimed in claim 10, wherein the removable tube element further comprises at least one flexible flange which is adapted to fit into a mating slot along the edge of the deck to prevent water from entering the boat when the removable tube element is positioned in the sidewall of the boat.

12. An inflatable boat as claimed in claim 9, wherein the removable tube element further comprises a handle means.

13. An inflatable boat is claimed in claim 4 wherein the removable tube element further comprises a means for at least partially deflating the removable tube element.

14. A method of providing access to an inflatable boat having a deck provided with a plurality of inflatable tube elements which extend at least partially around the deck to form a sidewall of the boat, including means for inflating and deflating said tube elements, one of the tube elements being removable from the sidewall to create a space large enough to permit a diver to enter or leave the boat through said space, the removable tube element being provided with at least one hoop flange attached to a first end thereof and adapted to fit around the periphery of an end of the adjacent inflatable tube element, said method comprising the steps of:

at least partially deflating the removable tube element so that the at least one hoop flange can be removed from the periphery of the adjacent inflatable tube element; and, removing the partially deflated removable tube element from the deck of the boat to provide a space in the sidewall.

* * * * *